US009567818B2

(12) United States Patent
Eidem et al.

(10) Patent No.: US 9,567,818 B2
(45) Date of Patent: Feb. 14, 2017

(54) METHOD AND APPARATUS FOR DRILLING AND LINING A WELLBORE

(75) Inventors: Morten Eidem, Trondhein (NO); Steinar Wasa Tverlid, Bjørøyhamm (NO); Jafar Abdollahi, Trondheim (NO); Arne Torsvoll, Hundvåg (NO)

(73) Assignee: STATOIL PETROLEUM AS, Stavanger (NO)

( * ) Notice: Subject to any disclaimer, the term of this patent is extended or adjusted under 35 U.S.C. 154(b) by 357 days.

(21) Appl. No.: 13/982,000

(22) PCT Filed: Feb. 7, 2011

(86) PCT No.: PCT/EP2011/051762

§ 371 (c)(1),
(2), (4) Date: Oct. 23, 2013

(87) PCT Pub. No.: WO2012/107075

PCT Pub. Date: Aug. 16, 2012

(65) Prior Publication Data

US 2014/0034391 A1 Feb. 6, 2014

(51) Int. Cl.

| | |
|---|---|
| ***E21B 23/01*** | (2006.01) |
| ***E21B 7/20*** | (2006.01) |
| ***E21B 43/10*** | (2006.01) |

(52) U.S. Cl.

CPC ..... *E21B 23/01* (2013.01); *E21B 7/20* (2013.01); *E21B 43/101* (2013.01)

(58) Field of Classification Search

USPC ..... 175/57, 230

See application file for complete search history.

(56) References Cited

U.S. PATENT DOCUMENTS

| | | | |
|---|---|---|---|
| 2003/0217865 | A1 | 11/2003 | Simpson et al. |
| 2009/0090508 | A1 | 4/2009 | Brouse |
| 2009/0107675 | A1 | 4/2009 | Eriksen et al. |

FOREIGN PATENT DOCUMENTS

| | | | |
|---|---|---|---|
| WO | WO 2007/011906 | A1 | 1/2007 |

*Primary Examiner* — Taras P Bemko

(74) *Attorney, Agent, or Firm* — Birch, Stewart, Kolasch & Birch, LLP

(57) ABSTRACT

Apparatus for drilling and lining a wellbore is described herein. A method of drilling and lining a wellbore is also described herein. A liner hanger is provided, secured in use on a liner. The liner hanger is operable selectively to be set and unset. The liner hanger is adapted to support the liner within an existing casing when set and to release the liner from the casing when unset. A liner hanger setting tool is provided, secured in use on a drill string. The liner hanger setting tool is actuatable selectively to set and unset the liner hanger. The liner hanger setting tool is operable selectively to be activated and deactivated. The liner hanger setting tool is adapted to attach to the liner and/or liner hanger when activated, to support the liner, and to release from the liner and/or liner hanger when deactivated. The method comprises the following steps: (a) setting the liner hanger by actuating the liner hanger setting tool; (b) deactivating the liner hanger setting tool; (c) extending the borehole using the drill string; (d) returning the drill string to its position at the setting step or the deactivating step; (e) activating the liner hanger setting tool; (f) unsetting the liner hanger by actuating the liner hanger setting tool; and (g) lowering the liner down the extended borehole on the drill string.

3 Claims, 6 Drawing Sheets

METHOD AND APPARATUS FOR DRILLING AND LINING A WELLBORE

TECHNICAL FIELD

The present invention relates to a method and apparatus for drilling and lining a wellbore.

BACKGROUND

A typical procedure for extending and completing or lining a wellbore is as follows. In this procedure it is assumed that an existing casing is already installed in the wellbore, with a tubular member being provided for hanging off the existing casing once the wellbore has been extended. The tubular member may be a completion screen or slotted liner, or any other such member, but for the sake of simplicity the tubular member will be referred to here as a liner. The casing may be a surface casing.

A drill bit on a drill string is used to drill a hole section so as to extend the wellbore to reach a target depth. The drill string is then pulled back to the previous casing shoe. A short trip is then typically performed to determine the hole condition before the completion string can be run in. The drill string is then pulled completely out of the hole, and the liner is then run into the hole on a completion string. When the completion string has reached the bottom of the hole (or a desired depth), the liner is hung off the existing casing.

However, the present applicant has appreciated the following issues with the above-described procedure.

Such a procedure is time consuming. A tripping out operation is required to pull out the drill string, with the liner then being assembled and a tripping in operation performed to run the liner into the borehole. This procedure can typically take two to five days.

Such a procedure also brings with it certain operational risks. The tripping out and tripping in can subject the formation to hydraulic forces, with the risk of formation instability occurring, and problem such as collapse or caving within the hole. If the hole condition is determined to be inadequate, for example in the case of instability resulting in collapse or caving, it may become necessary for the liner to be set before the target depth has been reached; the liner may become stuck and not be landed at the desired depth. The mechanical properties of a typical liner mean that it has insufficient strength to be rotated or tensioned to remove the hole collapses or caving materials during installation.

In addition, because of the length of time required for the tripping out and tripping in operations, the hole can be left open for some time; this leads to an increased risk of further formation instability, thereby increasing the risk of collapse or caving.

The present applicant has appreciated the desirability of addressing these issues.

SUMMARY

Apparatus for drilling and lining a wellbore is described herein. A liner hanger is provided, secured in use on a liner. The liner hanger is operable selectively to be set and unset. The liner hanger is adapted to support the liner within an existing casing when set and to release the liner from the casing when unset. A liner hanger setting tool is provided, secured in use on a drill string. The liner hanger setting tool is actuatable selectively to set and unset the liner hanger. The liner hanger setting tool is operable selectively to be activated and deactivated. The liner hanger setting tool is adapted to attach to the liner and/or liner hanger when activated, to support the liner, and to release from the liner and/or liner hanger when deactivated.

A method of drilling and lining a wellbore is described herein. A method is proposed comprising the following steps: (a) setting the liner hanger by actuating the liner hanger setting tool; (b) deactivating the liner hanger setting tool; (c) extending the borehole using the drill string; (d) returning the drill string to its position at the setting step or the deactivating step; (e) activating the liner hanger setting tool; (f) unsetting the liner hanger by actuating the liner hanger setting tool; and (g) lowering the liner down the extended borehole on the drill string. The method may comprise repeating steps (a) to (g), if required. The method may comprise repeating steps (a) and (b), and subsequently removing the drill string from the wellbore.

The liner hanger may be operable to be set and unset multiple times. The liner hanger setting tool may be actuatable to set and unset the liner hanger multiple times. The liner hanger setting tool may be operable to be activated and deactivated multiple times. The liner hanger setting tool may be adapted to activate by expansion, and to deactivate by retraction; in this sense the liner hanger setting tool may be an expandable liner hanger setting tool.

Any suitable tubular member may be used in place of the liner, with terms such as "liner hanger", "liner hanger setting tool", and "lining" being interpreted accordingly. Likewise, any tubular may be used in place of the casing.

The liner hanger setting tool may be adapted to become smaller in outer diameter when deactivated and released from the liner hanger. The liner hanger setting tool can be drifted through the inside of the liner hanger and liner when a drilling operation is started. The liner hanger setting tool can be considered to be part of the drilling assembly during a drilling operation. The liner hanger setting tool, when deactivated, preferably gives sufficient opening flow area for return mud flow during circulation. After making a hole, the liner hanger setting tool can be pulled back with the drilling assembly to a depth such that the liner hanger setting tool is positioned at the same depth as the liner hanger. The liner hanger setting tool can then be activated to engage with the liner hanger. The liner hanger setting tool can then be actuated to release (unset) the liner hanger. The liner hanger setting tool effectively connects the liner hanger and liner to the drilling assembly. After the unset operation, the drilling assembly together with liner, liner hanger, and liner hanger setting tool are moveable through the inside casing and can be lowered down into the hole.

The following steps may be performed prior to the above-mentioned steps (a) to (g): (i) run in the liner joint by joint from the rig; (ii) assemble the liner hanger and hang the last joint of the liner in a false rotary table; (iii) run in a drill bit and bottom hole assembly (BHA) followed by drill string; (iv) pick up the liner hanger setting tool and assemble on drill string; (v) connect the liner hanger setting tool to the liner hanger; (vi) run in drilling assembly with liner.

In setting up for a method as described herein, a guide open-ended shoe can be installed on bottom of a first completion screen/slotted liner (CS-SL) and run into the hole joint by joint through a rotary table. Other completion components with acceptable minimum inner diameter can be also assembled on the CS-SL. On the last joint of CS-SL, the liner hanger with packer (LHP) and polished bore receptacle (PBR) can be assembled and hung off in a false rotary table to run the drilling assembly inside the CS-SL. The drilling assembly (including bit, under-reamer, MWD, rotary steerable system, etc) can be run inside the CS-SL and followed by drill pipes joint by joint until the under-reamer passes the end of CS-SL. The liner hanger setting tool (LHST) can then be picked up and assembled on the drill string. Then the LHST can be activated and latched with the liner hanger at the surface rig. The drill string with attached liner including liner hanger and LHST can then be run in-hole as one string. Tripping-in can be stopped at a desired depth at which the liner hanger is to be set and the CS-SL hung; the CS-SL would normally be located inside the installed casing with the bottom of the CS-SL inside the casing.

The LHST can then be actuated in order to set the liner hanger inside the casing. The actuation method for the LHST can for example be hydraulic, mechanical, or a combination of these. When the liner hanger is set and CS-SL is parked inside the casing, a weight indicator would show loss of CS-SL weight, indicating successful parking. The LHST can be released from liner hanger and a command sent from the surface to deactivate (e.g. compress) the LHST (e.g. smaller outer diameter). After contraction, the drill string is ready to start making or drilling a hole as the LHST is now driftable through the inside of the liner hanger and inside the CS-SL (i.e. it can easily pass through the inside of the parked CS-SL). The mud can be circulated through the inside of the drill string and mud with cuttings can be returned through the open hole annulus and later inside the parked CS-SL. The outer geometry of the LHST after contraction should therefore preferably provide a sufficient opening area for returned flow (minimum flow restriction for returned mud). The first interval can be drilled with the drill bit and BHA while the LHST is part of drilling string and it is able freely to rotate inside the parked CS-SL. After reaching a desired depth or total depth (TD), the hole can be cleaned out by bottoms-up circulation and the drill string can be pulled out until the LHST has reached the same depth as the liner hanger. The LHST can then be activated (e.g. expanded) by use of a command from the surface, and it latches to liner hanger as a result. The liner hanger can then be unset by actuating the LHST. At this time, the liner hanger will be fully disengaged from the casing and the CS-SL will be connected to the drill string (connection point is LHST and liner hanger). The two strings (i.e. drill string and CS-SL) are considered as one string and can then easily be tripped in through the inside of the casing and run in to the open hole. After the CS-SL reaches the bottom of the open hole, or stops at a desired depth, the LHST is actuated to set the liner hanger. The liner hanger is set and the LHST is released from the liner hanger. If the plan is to drill a second interval, the LHST can then be deactivated (compressed or become smaller in diameter) again and operation can continue in a similar manner as described above.

Further information relating to the apparatus and method is provided below.

DETAILED DESCRIPTION

A system and method according to an embodiment of the present invention will now be described with reference to FIGS. 1 to 10. These figures show the state of the system at a number of stages of the method, starting at FIG. 1 and progressing through to FIG. 10. The same components are shown in each figure (except in FIG. 10 where some components are out of view), and these components are therefore labelled only in FIG. 1 or FIG. 2.

Figure 1:
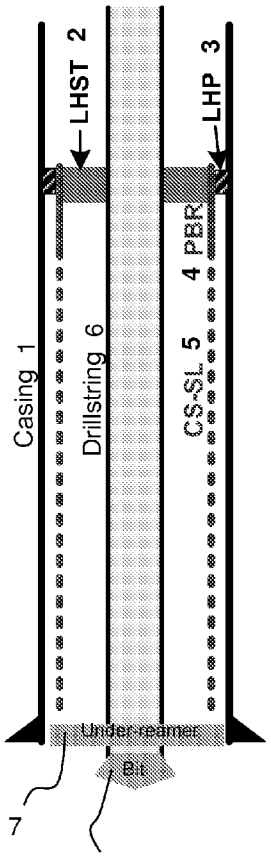
FIGS. 1 to 10 illustrate an apparatus embodying the present invention at a number of stages of a method embodying the present invention, starting at FIG. 1 and progressing through to FIG. 10.

FIG. 1 illustrates a casing 1 and a system comprising a liner hanger setting tool (LHST) 2, a liner hanger (or liner hanger packer) LHP 3, a polished bore receptacle (PBR) 4, a completion screen/slotted liner (CS-SL) 5, a drill string 6, an under-reamer 7, and a drill bit 8.

The LHP 3 may be a liner hanger with a packer and seal assembly. The LHP 3 is adapted and operable to perform multiple set/unset/re-set operations downhole. The LHP 3 is preferably retrievable.

The LHST 2 is adapted to set and unset the LHP 3, and is considered to be different to any previously-known LHST. The LHST 2 is an advanced liner hanger setting tool having two notable features. Firstly, the LHST 2 has a multi-actuation capability, allowing it selectively set and unset the LHP 3 multiple (in theory unlimited) times, on demand. Secondly, the LHST 2 has a multi-activation capability, allowing it to activate and deactivate multiple (in theory unlimited) times during the drilling procedure, on demand. In one embodiment, the LHST 2 is activated by expanding and deactivated by collapsing, assuming a larger or reduced diameter respectively. In particular, the LHST 2 is operable selectively to be deactivated (become smaller in diameter) when drilling. The LHST is also operable selectively to be activated (become larger in diameter) for setting and unsetting the LHP 3 and for supporting the CS-SL 5. As will be apparent from the description below, a benefit of a liner hanger setting tool according to an embodiment of the present invention is that there is no need for an extra trip to lay down the LHST 2 after hanging the LHP 3.

The PBR 4 is a polished bore receptacle the same as or at least similar to a conventional PBR.

The CS-SL 5 is the same as or at least similar to a conventional completion screen or slotted liner/pre-drilled liner, which are mainly run in the last hole section of oil and gas wells. It will be appreciated that any tubular member may be used in place of the CS-SL 5.

The drill string 6 and drill bit 8 are the same as or at least similar to a conventional drill string and drill bit respectively.

The under-reamer 7 is the same as or at least similar to a conventional under-reamer adapted and operable to enlarge a borehole to enable the CS-SL 5 to be run in.

FIG. 1 illustrates the system at an initial stage of a method embodying the present invention. The CS-SL 5 is hung off the inside the previous casing by use of the drill string 6. This can be achieved by first running the CS-SL 5 into the hole joint by joint, followed by the LHST 2, LHP 3 and PBR 4. Then, the drill string 6 can be run inside the CS-SL 5, the drill string 6 including drill bit 8, rotary steerable system (not shown), MWD (not shown) and under-reamer 7. The LHST 2 can then be activated to connect the CS-SL 5 to the drill string 6 so that the two strings can be run as one system further into the hole. The LHST 2 can then be actuated so as to set the LHP 3 inside the previous casing 1. The bottom of the CS-SL 5 is landed close to the shoe depth of the previous casing 1. This results in the arrangement as shown in FIG. 1.

Figure 2:
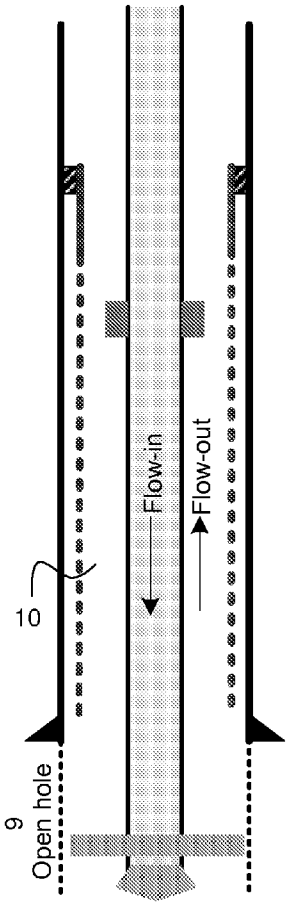

The LHST 2 is then deactivated so that it collapses (assuming a smaller diameter) so that the system is ready to start drilling. FIG. 2 shows the system in a subsequent drilling phase. The first formation interval is drilled by the drill bit 8 and under-reamer 7 to form an open hole 9, during which time the CS-SL 5 is temporarily hung off the inside of the casing 1. Drilling of the hole 9 is continued until the bit 8 reaches a desired depth (e.g. depending on hole condition) or reaches the total depth (TD). During drilling, drilling fluid is pumped through the drill string 6 in a manner the same or similar to a conventional drilling method, and returned via an annulus 10 between the drill string 6 and the SC-SL 5 as shown by the arrows in FIG. 2. When the drill bit 8 has reached the depth required, this results in the arrangement as shown in FIG. 2.

Figure 3:
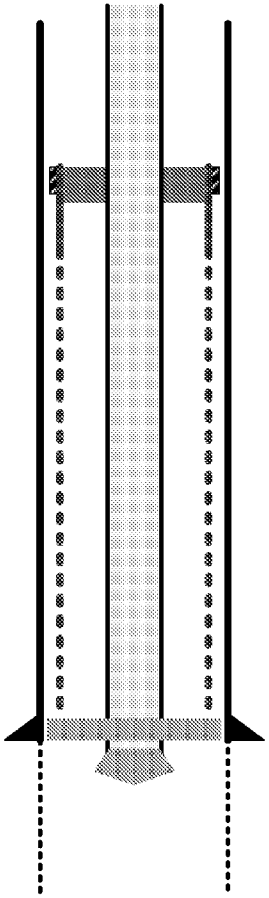

After reaching the required depth, the drill string 6 is pulled back to a point where the LHST 2 can be activated and the LHP 3 unset. The LHST 2 is then activated to engage with the CS-SL 5, and the LHST 2 is then actuated to unset the LHP 3. This results in the arrangement as shown in FIG. 3.

Figure 4:
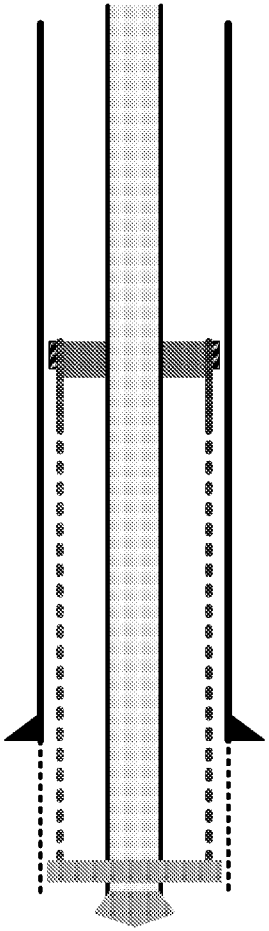
Figures 5, 6, 7, 8, 9, 10:
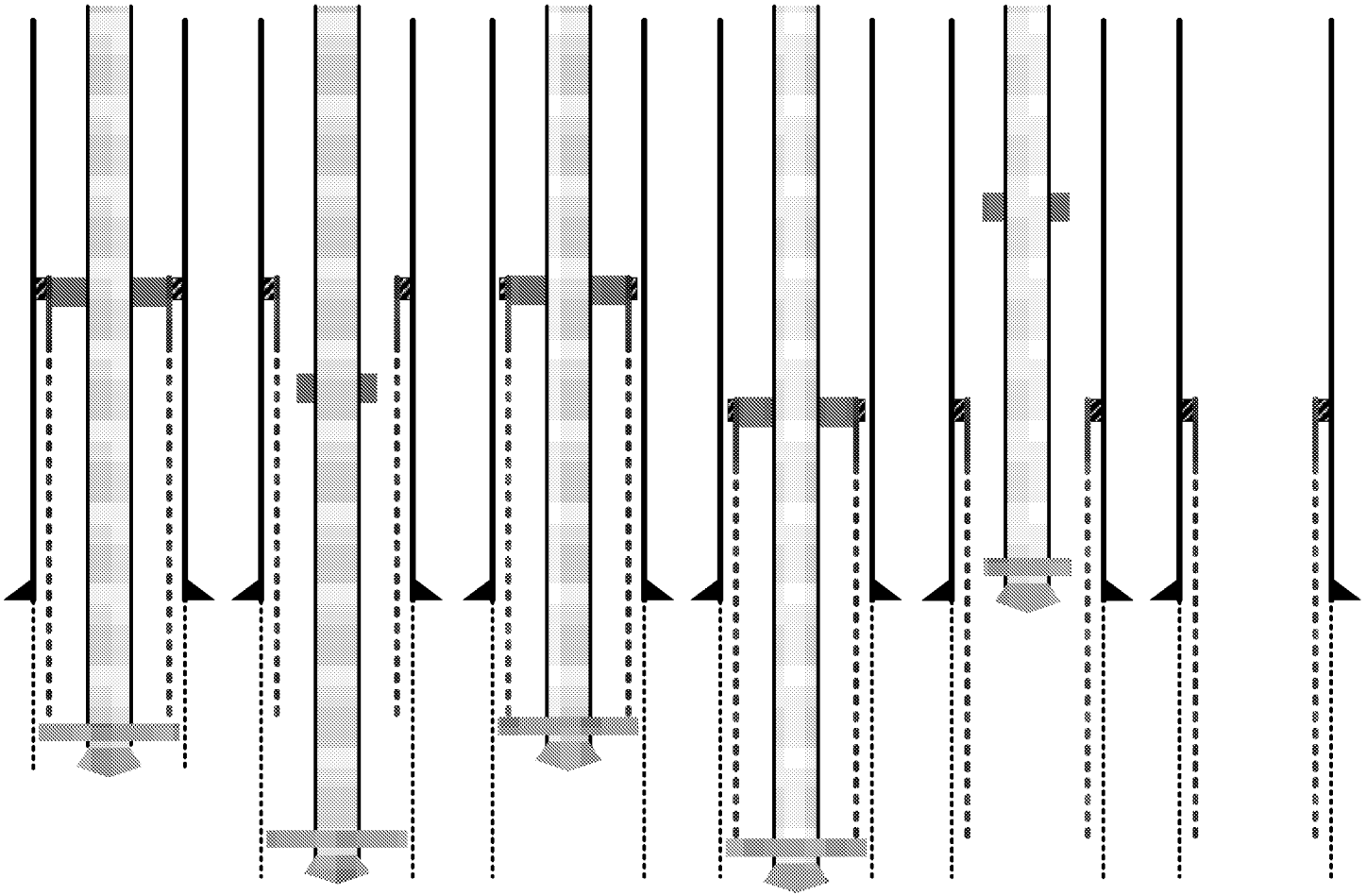

The CS-SL 5 together with the drill string 6 is then lowered to the bottom of the hole 10 as shown in FIG. 4. Following that, the CS-SL is hung off again inside the casing 1 by actuating the LHST 2 to set the LHP 3, resulting in the arrangement as shown in FIG. 5. The arrangement of FIG. 5 is similar to FIG. 1, though with the system (LHST 2, LHP 3, PBR 4, CS-SL 5, drill string 6, under-reamer 7, drill bit 8) positioned lower down. Significantly, the previously open hole 10 has now been isolated by the CS-SL 5, without much delay and without any tripping out of the drill string 6 having been required.

Drilling can then continue for another interval, for as many (if any) further intervals as required to position or set the CS-SL 5 at the required depth. FIGS. 6 to 8 are equivalent to FIGS. 2 to 3, but performed at an interval depth lower down. Briefly, FIG. 6 shows the LHST 2 in a deactivated state, with a second formation interval being drilled to reach the TD. FIG. 7 shows the drill string 6 having been pulled back, and the LHST 2 actuated to unset the LHP 3. The lowered CS-SL 5 is shown in FIG. 8. This would be followed by actuating the LHST 2 again to set the LHP 3 (equivalent to FIG. 5).

After the CS-SL 5 has been run in to the TD and hung within the casing 1, the drill string 6 is released from the LHP 3 by deactivating the LHST 2, and the drill string 6 is pulled out of the hole as shown in FIG. 9. FIG. 10 illustrates the CS-SL 5 in place in the open hole interval and ready for a completion phase. It is noted that this technology can also include expansion technology, e.g. expandable screen.

In summary, a method is proposed comprising the following steps. The liner hanger is set by actuating the liner hanger setting tool (FIG. 1). The liner hanger setting tool is deactivated and the borehole is extended using the drill string (FIG. 2). The drill string is returned to its position at the setting and deactivating steps, the liner hanger setting tool is activated, and the liner hanger is unset by actuating the liner hanger setting tool (FIG. 3). The liner is lowered down the extended borehole on the drill string (FIG. 4). These steps may be repeated, if required (FIGS. 5 to 8), any desired number of times. When the desired depth has been reached, the method may comprise repeating the first two stated steps (setting the liner hanger by actuating the liner hanger setting tool, and deactivating the liner hanger setting tool), and subsequently removing the drill string from the wellbore, retracting the under-reamer to allow it to travel through the liner, and leaving the liner in place. The method may comprise rotating the liner together with the drill string. The method may comprise circulating drilling fluid and/or mud and/or cuttings back towards the surface within the liner.

Figure 11:
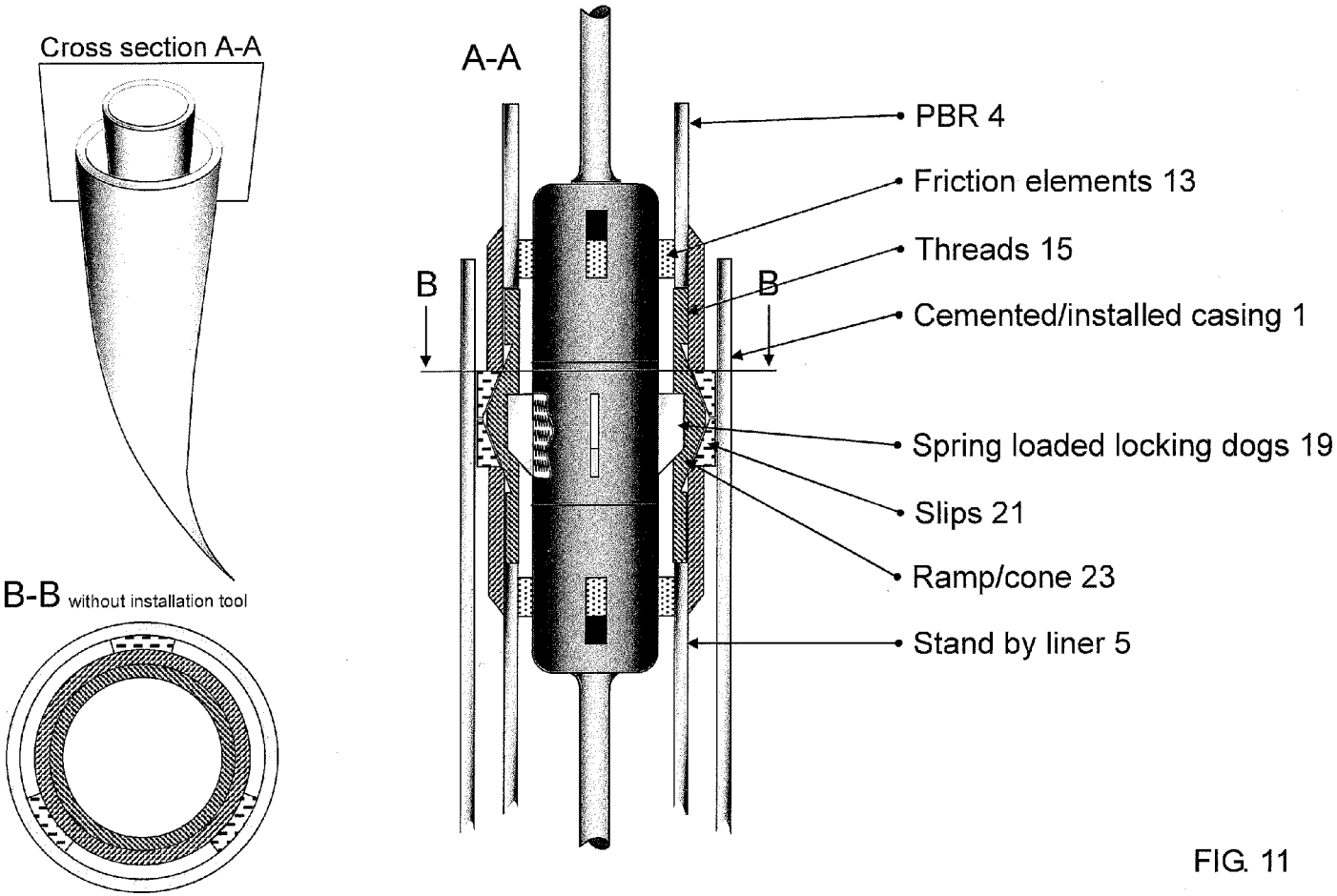
FIGS. 11 and 18 illustrate in more detail an apparatus embodying the present invention liner, showing in particular more detail in one possible implementation of a liner hanger setting tool and a liner hanger in an embodiment of the present invention.
Figure 18:
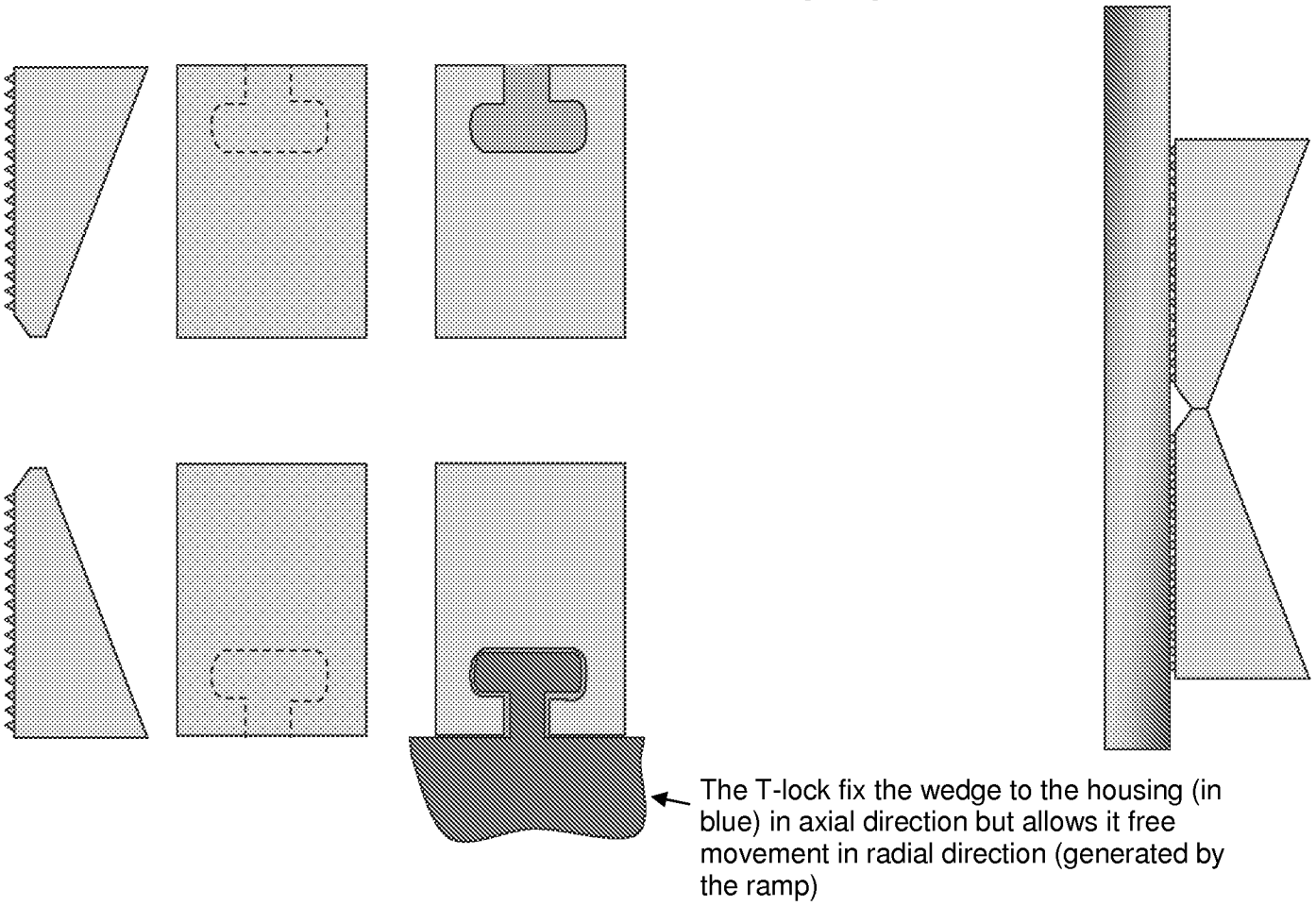

FIG. 11 illustrates more detail in one possible implementation. Referring to FIG. 11, the liner hanger setting tool (LHST) 2 described above can be considered as comprising friction elements 13, spring loaded locking dogs 19, threads 15 and ramp/cone 23. The liner hanger 3 described above can be considered as comprising slips 21. The main part (middle/right) of FIG. 11 is a cross section through A-A of the perspective view in the top left of FIG. 11; in the bottom left of FIG. 11 is shown a cross sectional view B-B as marked in the main part of FIG. 11. Detail of the slips 21 is shown in FIG. 18.

Figure 14:
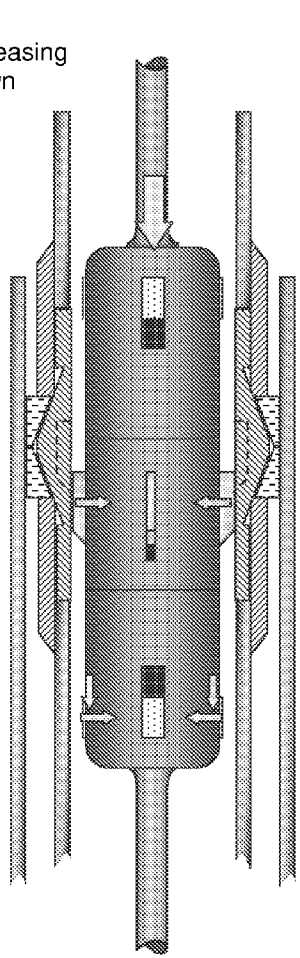
FIGS. 12 to 17 illustrate the apparatus of FIGS. 11 and 18 at a number of stages of a method embodying the present invention, from FIG. 12 and progressing through to FIG. 17.
Figure 13:
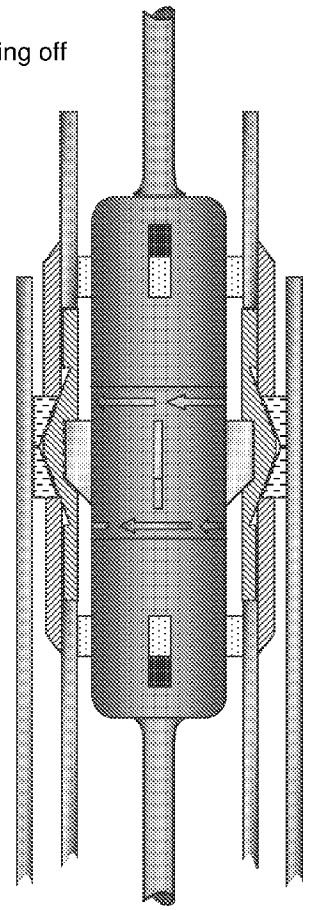
Figure 12:
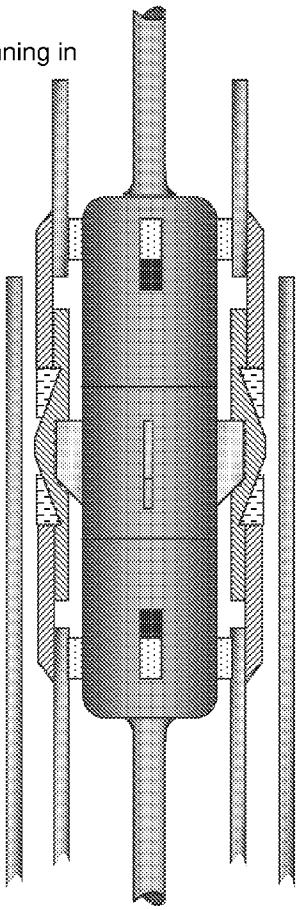
Figure 17:
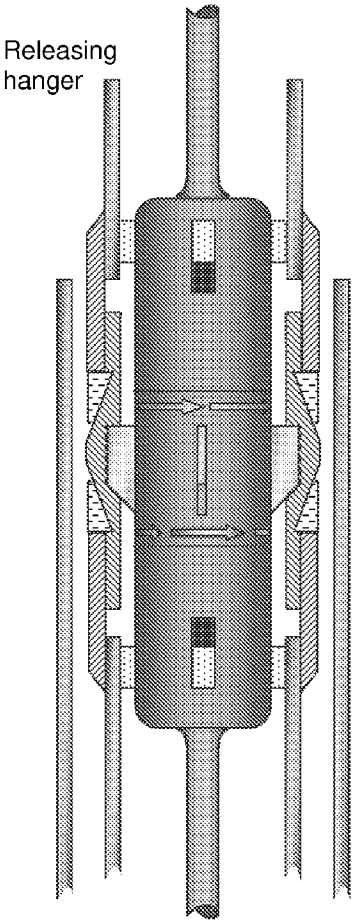
Figure 16:
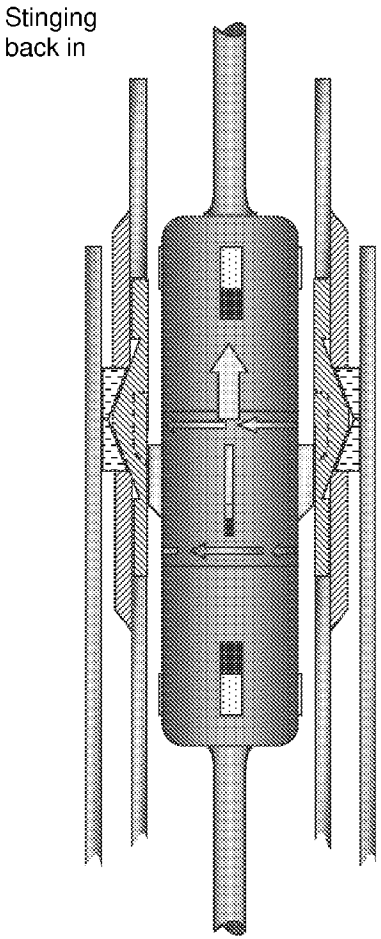
Figure 15:
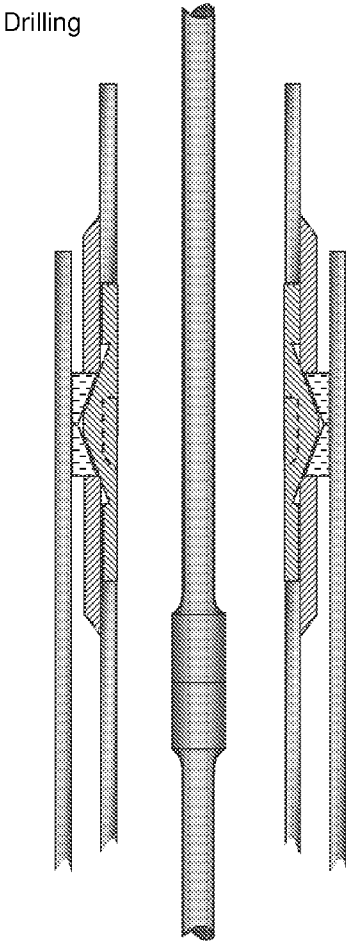

FIG. 12 shows the apparatus of FIG. 11 being run in to the casing 1. FIG. 13 illustrates a step of setting the liner hanger 3 by actuating the liner hanger setting tool 2; this is achieved by pushing the slips 21 along ramp/cone 23, through rotation of the central part of the tool, thereby urging the slips 21 into gripping contact with the casing 1. The friction elements 13 generate counter hold to the locking dogs 19 before the slips 21 touch the casing 1; the friction elements 13 can be seen as moving slightly within the tool from FIG. 12 to FIG. 13, with lower and upper friction elements 13 moving towards one another, as the slips 21 themselves move together and along the ramp/cone 23. FIG. 14 illustrates a step of deactivating the liner hanger setting tool, which is achieved by drawing in the locking dogs 19 (by pushing down/applying weight) and friction elements 13. FIG. 15 illustrates a step of extending the borehole using the drill string, followed by a step illustrated in FIG. 16 of returning the drill string to its position at the setting step or the deactivating step. FIG. 17 illustrates a step of activating the liner hanger setting tool (by pushing out the locking dogs 19 and friction elements 13) and unsetting the liner hanger by actuating the liner hanger setting tool (achieved by moving the slips 21 down the ramp/cone 23 through rotation of the central part of the tool in an opposite manner to that shown in FIG. 13). This can then be followed by a step of lowering the liner down the extended borehole on the drill string.

An embodiment of the present invention is able to address the above-mentioned issues with previously-considered techniques. Compared with the previously-considered techniques, a drilling procedure used in an embodiment of the present invention is capable of drilling intervals and running in a CS-SL to isolate an open hole as quickly as possible. This can be done by relatively short depth intervals of, e.g. around 30 m. A technique embodying the present invention also allows the CS-SL to rotate together with drill string. A technique embodying the present invention also allows the returned mud and cuttings to be circulate out inside the CS-SL instead of an open hole annulus. A technique embodying the present invention also allows the potential to apply a dual circulation procedure to achieve better well control, better ECD, and better hole cleaning.

As the CS-SL is covering the drilled open hole section shortly after drilling, the risks associated with formation collapse and caving (causing the CS-SL to get stuck) can be greatly minimized. The time exposure between drilling fluid and formation can be reduced substantially. More efficient well construction can also be achieved. An embodiment of this invention can easily be adapted to the existing drilling procedure. Use of an embodiment of the present invention can lead to a reduction in drilling risks, and can save time and cost compared to previously-considered techniques.

In a previously-considered method, the total borehole length would first be drilled with a drill string. After completing the drilling phase, the drill string is pulled out of the hole and CS-SL is assembled and run in hole joint by joint. The total assembly and tripping-in operation may take four to five days before reaching the bottom. The total exposure time between borehole rock and drilling fluid may take several days which lead to hole instability if time-dependent shale layers are present. It is common that formation is stable during drilling, but unstable when the CS-SL is tripped-in. Instability is seen as sloughing shale, wash-out holes, collapse shale, and so on. This situation leads to a necessity to install the CS-SL before the planned depth, which in many cases is not acceptable either technically or economically.

For a previously-considered technology of drilling-with-liner, the liner is subjected to several dynamic drilling loads as the liner is connected to the drill string during: drilling, tripping, rotation, and circulation. The plain liner is generally stronger than CS-SL and in many cases it is allowable to subject the plain liner to curtain loads. However, the risk of connection failure or parted liner can increase for high deviated well or long reach well. In some cases, equivalent circulation density (ECD) is create a limitation for drilling-with-liner as the returned flow passed through the narrow clearance: open hole and outside liner.

By applying a technique as herein described with reference to the drawings, the CS-SL is able to rest during the drilling phase. This means that the CS-SL will not be subjected to severe dynamic loads during drilling: rotation, tension, compression, bending, etc.

By applying a technique as herein described with reference to the drawings, exposure time between the drilling fluid and rock can be reduced substantially because the CS-SL is parked down hole and ready to lower down and cased the open hole at shortest time as possible. For example, the time from stopping drilling to run CS-SL to the bottom of hole may take five days for a previously-considered method, while using a technique described herein it may around eight hours (under the assumption of: interval length=2000 m, stand length=30 m, tripping speed=4 minutes per stand).

By applying a technique as herein described with reference to the drawings, ECD can be improved as compared with a previously-considered drilling-with-liner technique, as the cross section area for returned flow can be made larger.

It will be appreciated by the person of skill in the art that various modifications may be made to the above described embodiments without departing from the scope of the present invention. For example, although the above LHST 2 has been described as an expandable liner hanger tool, other means of selectively engaging with and supporting the CS-SL 5 (or other tubular member such as conventional liner pipe) can be used, for example retractable pins or moving arms. The liner hanger setting tool need merely be adapted in some suitable manner to attach to the liner and/or liner hanger when activated and to release from the liner and/or liner hanger when deactivated.

The invention claimed is:

1. A method of drilling and lining a wellbore, comprising: providing a liner hanger, the liner hanger being secured in use on a liner, operable selectively to be set and unset, and adapted to support the liner within an existing casing when set and to release the liner from the casing when unset; providing a liner hanger setting tool, the liner hanger setting tool being secured in use on a drill string, actuatable selectively to mechanically set and unset the liner hanger, operable selectively to be activated and deactivated, and adapted to attach to the liner and/or liner hanger when activated, to support the liner, and to release from the liner and/or liner hanger when deactivated; and further comprising:

(a) setting the liner hanger by actuating the liner hanger setting tool, wherein actuating the liner hanger setting tool for setting the liner hanger comprises rotating a part of the liner hanger setting tool in a first direction;
(b) deactivating the liner hanger setting tool;
(c) extending the borehole using the drill string while the liner hanger is set;
(d) returning the drill string to its position at the setting step or the deactivating step;
(e) activating the liner hanger setting tool;
(f) unsetting the liner hanger by actuating the liner hanger setting tool, wherein actuating the liner hanger setting tool for unsetting the liner hanger comprises rotating said part of the liner hanger setting tool in a second direction, the second direction being opposite to the first direction; and
(g) lowering the liner down the extended borehole on the drill string.

2. The method as claimed in claim 1, comprising repeating steps (a) to (g).

3. The method as claimed in claim 1, comprising repeating steps (a) and (b), and subsequently removing the drill string from the wellbore.

* * * * *